United States Patent [19]

Rix et al.

[11] 3,985,220

[45] Oct. 12, 1976

[54] TABULATOR APPARATUS FOR A TYPEWRITER CARRIAGE MOVING IN STEPS OF DIFFERENT LENGTH

[75] Inventors: Albert Rix; Dieter Drogi, both of Wilhelmshaven, Germany

[73] Assignee: Olympia Werke KG, Wilhelmshaven, Germany

[22] Filed: Oct. 26, 1971

[21] Appl. No.: 192,370

[30] Foreign Application Priority Data

Oct. 23, 1970 Germany ..... 2052017

[52] U.S. Cl. ..... 197/177; 197/84 B; 197/93; 197/96; 197/183; 197/187

[51] Int. Cl.[2] ..... B41J 25/18; B41J 19/58

[58] Field of Search ..... 197/64, 70, 82, 84 R, 197/84 A, 84 B, 92, 93, 94, 95, 96, 176, 177, 178, 179, 183, 187

[56] References Cited

UNITED STATES PATENTS

| | | | |
|---|---|---|---|
| 974,438 | 11/1910 | Schaaff | 197/177 |
| 1,054,875 | 3/1913 | Smith | 197/179 |
| 1,820,329 | 8/1931 | Seidelinger | 197/82 |
| 2,165,223 | 7/1939 | Chisholm | 197/84 A |
| 2,328,097 | 8/1943 | Reid | 197/84 B |
| 2,805,749 | 9/1957 | Kleinschmidt | 197/179 |
| 2,945,578 | 7/1960 | Beccio | 197/84 B |
| 2,972,401 | 2/1961 | Salto | 197/84 B |
| 3,018,870 | 1/1962 | Lambert et al. | 197/84 B |
| 3,092,000 | 6/1963 | Williams | 197/82 X |
| 3,121,487 | 2/1964 | Gassino | 197/176 |
| 3,315,776 | 4/1967 | Barkdoll et al. | 197/82 X |
| 3,346,087 | 10/1967 | Colombo et al. | 197/187 X |
| 3,358,806 | 12/1967 | Krauss et al. | 197/84 R |
| 3,417,849 | 12/1968 | Terenzani | 197/84 R X |
| 3,428,159 | 2/1969 | Klingner et al. | 197/64 |
| 3,441,119 | 4/1969 | Schweizer | 197/94 |
| 3,547,245 | 12/1970 | Okcuoglu et al. | 197/84 R X |
| 3,646,268 | 2/1972 | Ricciardi et al. | 197/176 X |

*Primary Examiner*—E. H. Eickholt
*Attorney, Agent, or Firm*—Michael J. Striker

[57] ABSTRACT

A tabulator apparatus for a typewriter whose carriage can be manually set to make carriage steps of different length corresponding to the width of types of different exchangeable type carriers. The apparatus includes a manually shiftable transmission connecting the tab carrier and the escapement member with the carriage so that the carriage can move in larger carriage steps relative to the tab carrier.

14 Claims, 7 Drawing Figures

3
3a
3b
3c
3d
3e
49
49a
49b
49c
50
51
52
48
55
56
56a
57
58
87
85
60
11
11b
11c
59
61
61a
61b
62
62a
66
66a
6
7
7a
9
8
71
72
42
42a
42b
43
44
45
45a
46
47
54
53
41
40
36
18
12
5a
2
15
16
13
1
65
65a
65b
65c
65d
65e

TABULATOR APPARATUS FOR A TYPEWRITER CARRIAGE MOVING IN STEPS OF DIFFERENT LENGTH

BACKGROUND OF THE INVENTION

The present invention is concerned with a tabulating apparatus, particularly a tabulator apparatus which permits the release of the tabulating key prior to arriving at the tabulator stop. The typewriter has exchangeable type carriers which require carriage steps of different length.

The German Auslegschrift 1,815,871 and the corresponding U.S. Pat. No. 3,540,565 disclose a tabulating apparatus which cooperates with a rack bar escapement mechanism shiftable between conditions in which carriage steps of different length are obtained. The tabulator apparatus has a tab carrier bar on which tabs are mounted whose number and spacing corresponds to the smallest distance between two teeth of the escapement mechanism. The tabs are arranged in a row at different distances so that, after consideration of tolerances of the escapement pawl and the toothed escapement member, each tab is associated with a recess between two teeth of the escapement rack bar assuring a proper engagement of the escapement pawl. The tabulating apparatus of the prior art has the disadvantage that the escapement pawl, which is released by the differently spaced tabs in the respective stop positions has different time periods and distances available for engaging the escapement rack bar. Since the escapement pawl, after release by the tabulating arrangement, freely falls into the respective recess of the escapement rack bar, wrong engagements may occur so that the escapement pawl stops the carriage in a wrong column.

The apparatus according to the prior art requires an extremely great precision for the entire tabulating apparatus and for the escapement mechanism. Furthermore, all parts have to be very carefully adjusted during assembly, which increases the manufacturing costs. Another disadvantage of the apparatus of the prior art resides in that it can be used only for different types requiring only little different basic steps, so that only a limited number of fonts of types can be used with the apparatus.

SUMMARY OF THE INVENTION

It is one object of the invention to provide a tabulating apparatus for a typewriter or other business machine requiring different basic carriage steps, which is free of the disadvantages of the prior art.

Another object of the invention is to provide a tabulating apparatus which reliably operates, can be easily assembled, and can be used with different type carriers with different types requiring great differences between the carriage steps.

In accordance with these objects, an embodiment of the invention provides a tab carrier mounting uniformly spaced tabs whose number corresponds to the smallest possible steps of the carriage, and which tab carrier is connected by a transmission varying the lengths of the steps of the carriage in such a manner that the tab carrier, in the condition of the apparatus in which larger steps than the smallest basic steps are carried out by the carriage, moves relative to the carriage so that a corresponding smaller number of tabs are utilized, while the tab carrier performs a movement relative to the carriage by which the distances of the tabulator columns are accordingly increased.

In this manner the result is obtained, that for the individual tabulator columns, always a movement of the same length takes place between the tab carrier and the tabulator stop so that it is immaterial how long the carriage steps are.

In a preferred embodiment of the invention, the tab carrier has an end tab which is fixed in one position, and can be used irrespective of the length of the carriage steps which is selected. At the end of the tabulating movement of the carriage, the end tab is located to cooperate with the tabulator stop. In the end position of the carriage after a carriage return, the fixed end tab is spaced as many tab distances from the tabulator stop, as there are, for the respective selected division of the basic steps, within the distance of movement of the carriage between the end positions. It follows, that during tabulating always only so many tabs of the tab carrier are effective, as there are carriage steps larger than the smallest basic steps possible within the total movement of the carriage between the end positions.

The fixed end tab on the tab carrier, is always in the region of the tabulator stop when the carriage is in the end position corresponding to the end of a line. It follows, that the shifting of the distance varying transmission for the relative movement of the tab carrier, and thereby also the shifting of the escapement mechanism of the carriage to another carriage step, must take place in this end position of the carrier.

In the preferred embodiment, the transmission is shifted between two stages by a force accumulator so that every time the transmission is shifted, the carriage moves to the end position in which the force accumulator automatically shifts the transmission.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1*a* is a fragmentary end view;

FIG. 1*b* is a fragmentary side view;

FIG. 1*c* is a fragmentary sectional view illustrating a transmission;

FIG. 1*d* is a schematic fragmentary view illustrating the drive of the typewriter carriage by means of a transmission;

FIG. 1*e* is a fragmentary schematic view illustrating manually operated linkages for shifting the transmission and operating the tabulator stop and escapement pawl;

DESCRIPTION OF THE PREFERRED EMBODIMENTS

Figure 1A:
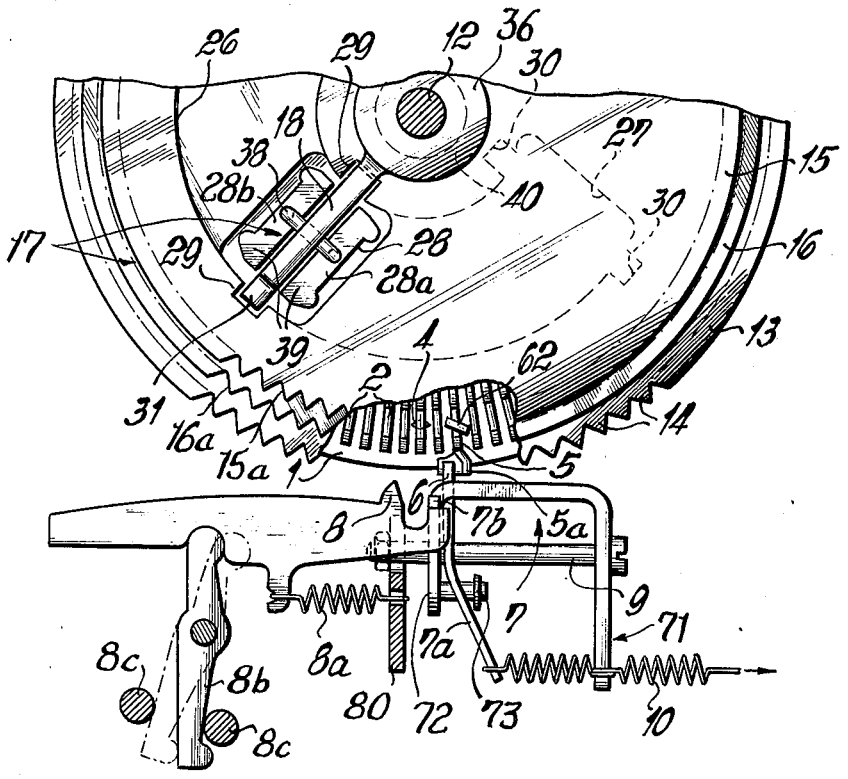
FIGS. 1*a* to 1*e* illustrate an embodiment of the invention with a circular tab carrier.
Figure 1B:
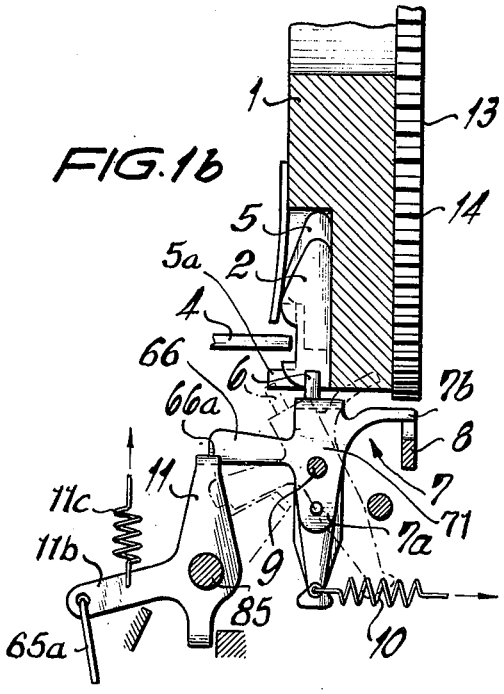
Figure 1C:
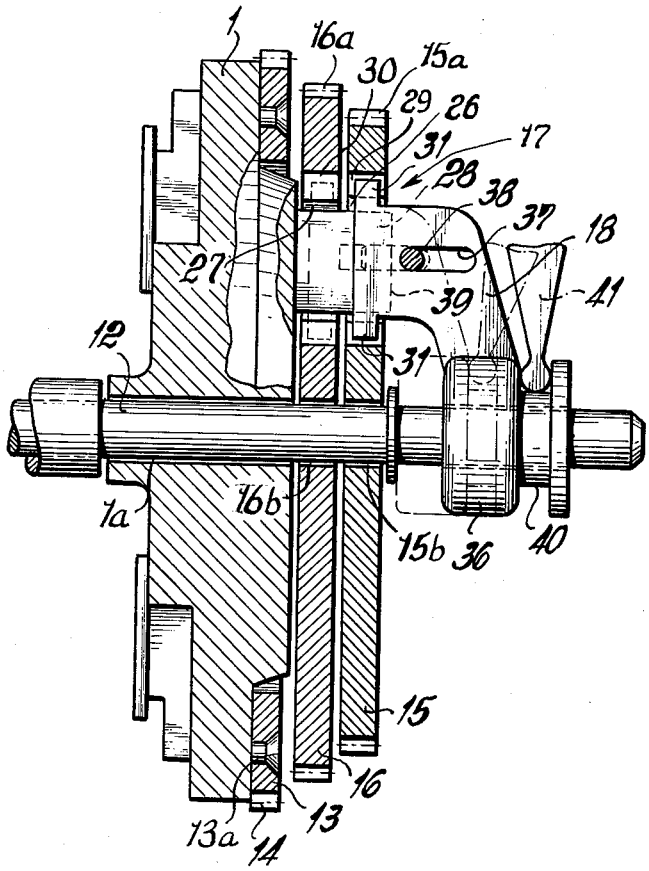
Figure 1D:
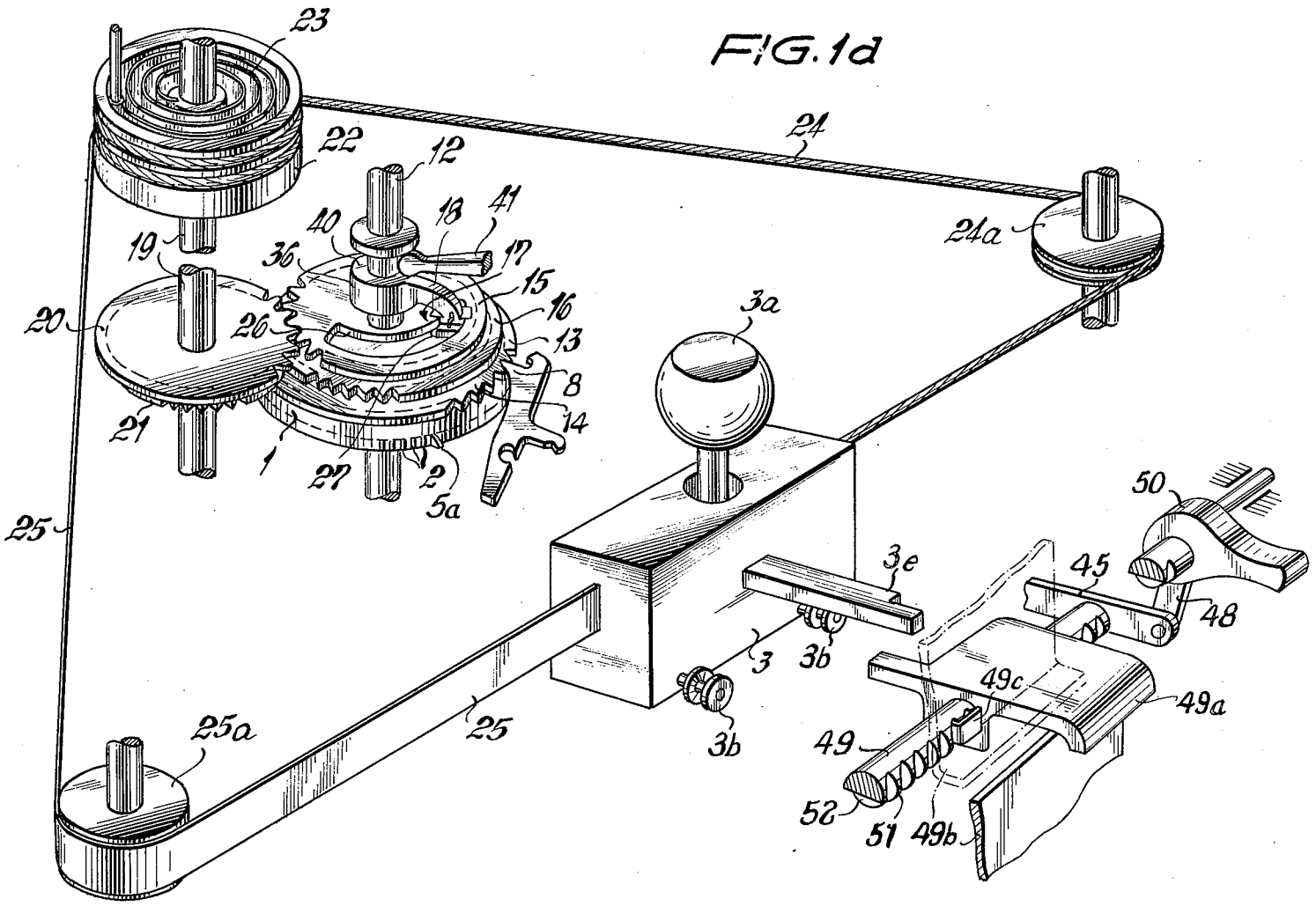
Figure 1E:
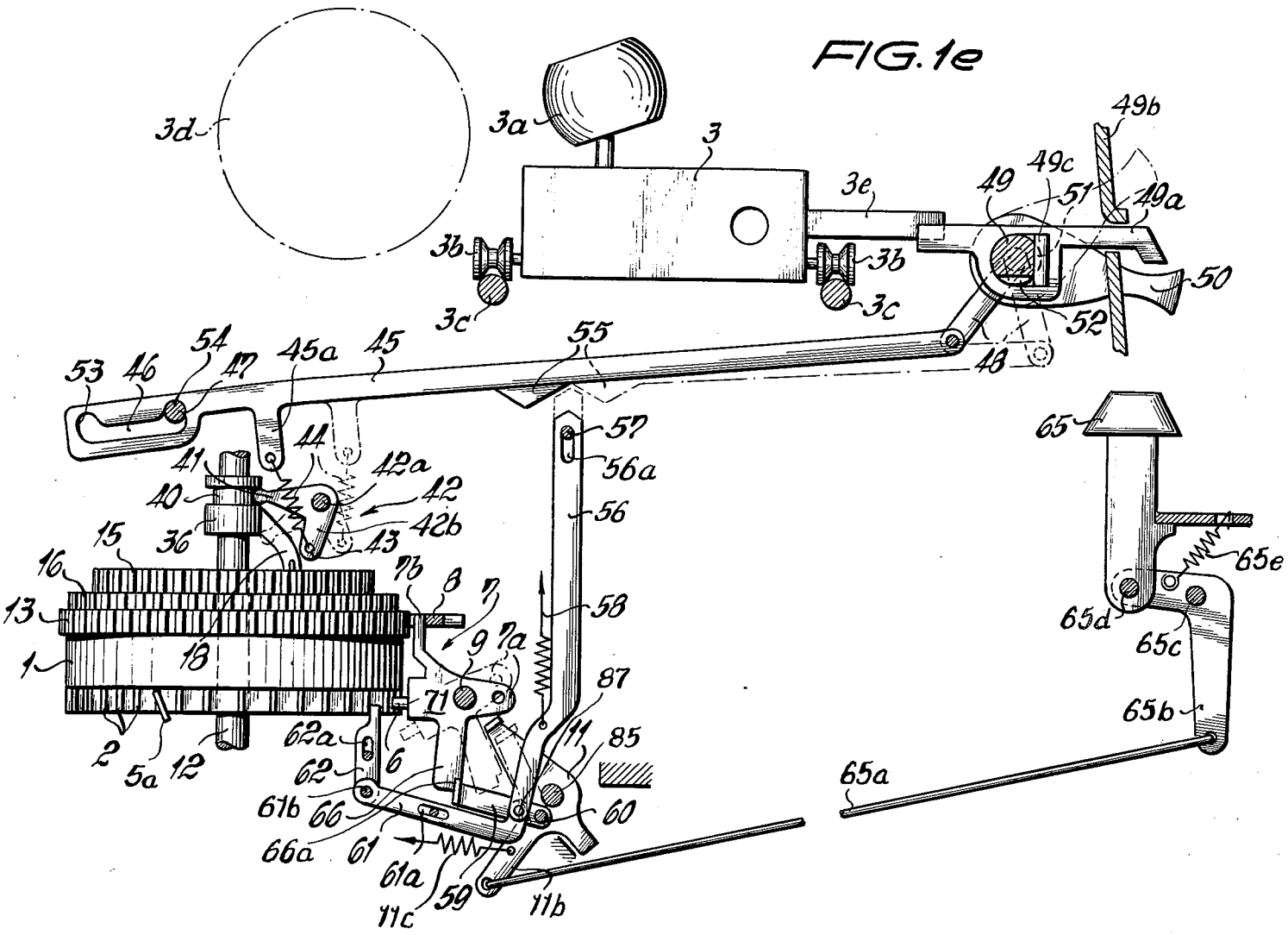

Referring first to the embodiment of FIG. 1*a* to FIG. 1*e*, particularly FIGS. 1*a* and 1*b* illustrate a circular tab carrier 1 provided with a circular row of tabs 2 whose number corresponds to the number of carriage steps possible between the end positions of the carriage 3, see FIGS. 1d and 1e. One of the tabs 2 is the fixed end tab 5 which is so constructed that it cannot be cleared by the standard clearing and setting means 4 by which the tabs 2 are cleared and set in the usual manner. Tabulator means 7 is mounted on a frame wall 80 by means of a shaft 9 on which a U-shaped stop member 71 is mounted for angular and axial movement. The shorter leg 72 has an arm 66, and another arm 7*b* cooperating with the escapement pawl 8. A member 7*a* is also movably mounted on shaft 9 and on a pivot means 73 on leg 72. The upper end of member 7*a* is the tabulator stop 6, which cooperates with set tabs 2, as described in the copending application of Dieter Drogi, Ser. No. 179,064, filed Sept. 9, 1971, and also with a slanted engagement face 5*a* on the fixed end tab 5. Tabulator means 7 permits release of the tabulator key 65, see FIG. 1*e*, after operation of arresting lever 11, prior to the engagement of tabulator stop 6. The fixed end tab 5, 5*a* engaging tabulator stop 6, effects through the tabulator means 7, particularly by arm 7*b*, release of the escapement pawl 8 for engaging a tooth 14 of the escapement member 13 by the action of spring 8*a* secured to wall 80. The slanted engagement face 5*a* engaging tabulator stop 6, turns tabulator means 7 so that the arm 7*b* releases the escapement pawl 8, which was lifted out of the teeth 14 of escapement member 13 by the arm 7*b*, and locked by arm 7*b* and stop member 71 whose arm 66 was locked by arresting lever 11, for example, during a complete tabulation of carriage 3 for the purpose of clearing all set tabs 2. Consequently, the end tab 5 is fixed at the end of the tab carrier 1, and in the construction in which the tab carrier 1 is circular, the fixed end tab 5 is located at a point of the circular tab carrier 1 which is located in the effective area of the tabulator stop 6 of the tabulator means 7, when carriage 3 has run to the end position corresponding to the end of the line, due to the action of the carriage drive spring 23, see FIG. 1*d*, after a tabulating movement.

A transporting roller 22 serves as housing for the carriage drive spring 23 which biasses carriage 3 to move in the writing and tabulating direction. A rope 24 and a band 25 are secured to the transporting roller 22 and to the carriage 3, and are guided over guide rollers 24*a* and 25*a*. The carriage 3 supports a type head 3*a* and has rollers 3b running on rails 3*c*, as best seen in FIG. 1*e* so that the exchangeable type head 3*a* cooperates with a platen 3*d*.

Tabulator means 7 is mounted on a shaft 9 for axial and angular movement against the action of a slanted spring 10. For effecting a tabulating movement, an angular arresting lever 11, see FIG. 1e and FIG. 1b, is turned by a tabulator 65 in counterclockwise direction about shaft 85 to the position shown in FIG. 1*b* and turns the U-shaped stop member 71 through its arm 66 so that the tabulator stop 6 is placed in the path of movement of tabs 2 and 5 of tab carrier 1. In this position, the tabulator means 7 is locked by the arresting level 11 engaging cutout 66*a*, until moved by a set tab 2, or by the longer fixed end tab 5, in axial direction to the left for releasing the escapement pawl 8 which is biassed by spring 8*a* which is secured to a frame bar 80, and arrested by the portion 7*b* of the U-shaped stop member 71 which is mounted on shaft 9. Escapement pawl 8 is movable between two positions defined by a lever 8*b* and two stops 8*c*. This arrangement in not an object of the invention and is described in detail in the U.S. patent application Ser. No. 179,064.

As best seen in FIG. 1*c*, the annular escapement member 13 with escapement teeth 14 is fixedly secured to by screws 13*a* to the circular tab carrier 1 and forms with the same and with transmission gears 15, 16 a unit which is mounted on a shaft 12 by means of central aligned bores 1*a*, 15*b*, 16*b*. Escapement member 13 has as many teeth 14, as there are tabs 2, 5 mounted on the tab carrier 1.

Two transmission gears 15 and 16 with gear rings 15*a*, 16*a*, are also freely rotatable on shaft 12, and form, together with a coupling key 18, a variable transmission 17 by which the length of the carriage steps is influenced. Coupling key 18 has a hub 36 mounted on shaft 12 for rotation and axial movement, and is provided with an annular groove 40, best seen in FIG. 1*c*, into which a shifting arm of a shifting member 41, best seen in FIGS. 1*c* and 1*e*, projects.

As shown in FIG. 1*d*, the transmission gears 15 and 16 mesh with drive gears 20 and 21, respectively, secured to shaft 19 which carries the transporting roller 22 forming the housing of the carriage drive spring 23. Depending on the two different transmission ratios between gears 15, 20 or gears 16, 21, carriage 3 is moved steps of different length when gears 15 and 16 turn together with escapement member 13 and tab carrier 1. The steps and the tabulating movement obtained by the escapement pawl 8 cooperating with escapement member 13, or by the tabulator means 7, are selectively transmitted through transmission gears 15 or 16, and gears 20 or 21 to the transporting roller 22 and thereby to the carriage 3.

The variable transmission 17, including coupling key 18, and transmission gears 15 and 16, is preferably constructed so that the coupling key 18 does not engage the hub regions of the transmission gears 15 and 16, but acts near the outer periphery of the transmission gears 15, 16. This arrangement assures a minimum play and relative movement between the tab carrier 1 and the transmission gears 15, 16 of the variable transmission 17. Transmission gears 15 and 16 have like sector-shaped overlapping cutouts 26, 27, respectively, through which a guide fork 28 projects which is secured to tab carrier 1, as best seen in FIGS. 1*a* and 1*c*. The end portion of coupling key 18 projects into the gap between the two prongs 28*a*, 28*b* of guide fork 28 so that the coupling key 18 is rigidly connected with the tab carrier 1 in two axially shifted positions in which the diametrically disposed radial projections 31 of coupling key 18 are respectively located in recesses 29 or 30 of the transmission 15 or 16. Recesses 29 or 30 open into the sector-shaped cutouts 26 or 27, respectively and are exactly aligned with each other in the tabulated end position of carriage 3, so that the shifting of the coupling key 18 for connecting a selected gear 15 or 16 with the tab carrier 1, and the variation of the length of the carriage step, takes place in this tabulated end position of carriage 3.

The recesses 29 and 30 are disposed in the cutouts 26 and 27 so that a relative movement can take place between the transmission gears 15 and 16, which is not blocked by the guide fork 28. The peripheral length of the sector-shaped cutouts 26 and 27 is designed so that the relative movement between transmission gears 15 and 16 can be at least as large as required by the different transmission ratios within a complete movement of the carriage 3 in the writing or tabulating direction to an end position which means that gears 15 and 16 can turn various angular distances undisturbed by guide fork 28.

The coupling key 18 is shifted on shaft 12 by member 41 between two positions in which either transmission gear 15 or transmission gear 16 is operative. Coupling key 18 has an elongated slot 37 through which a U-shaped pin 38 projects whose legs are secured to the surfaces of the two prongs 39 of guide fork 28. The annular tab carrier 1, the escapement member 13 secured thereto, and the transmission 17 including transmission gears 15, 16 and the coupling key 18, form a compact unit with aligned bores 1*a*, 15*b*, 16*b*, which can be mounted on shaft 12. The two end positions of coupling key 18 are determined by engagement of the yoke portion of pin 38 with the ends of slot 37. When the coupling key 18 is located in one of these end positions, the coupling projections 31 are located in the coupling recesses 29 or 30 of the two transmission gears 15 and 16, respectively.

As shown in FIG. 1*e*, a force accumulator 42 includes the angular lever 41, one arm of which is located in the annular groove 40 of hub 36 of coupling key 18, is mounted on a stationary pivot 42*a* for angular movement between two positions, and is biassed by an overcenter spring 44 which is secured to a projection 45*a* on a link 45. The spring 44 is secured to a stud 43 on the other arm 42*b* of angular lever 41, and the arrangement is such that shifting of link 45 between two positions causes the snapping of angular lever 41 to one of its two end positions while spring 44 passes through a dead center position across pivot 42*a* so that angular lever 41, and also coupling key 18 are arrested in two end positions by the overcenter spring 44. Spring 44 and angular lever 41 serve as a force accumulator 42 capable of alternately moving coupling key 18 to two end positions determined by the pin 38 and slot 37 for engaging gears 15 or 16.

Link 45 has an end portion with a slot 46 at whose ends arresting recesses 53 and 54 are located which cooperate with a stationary arresting pin 47. Spring 44 urges link 45 to a position in which one of the arresting recesses 53 or 54 engages pin 47 to hold link 45 in one of two end positions. The other end of link 45 is connected by a lever 48 fixed on a margin stop rod 49 which can be turned between two positions by a manually operated setting handle 50. Margin stop rod 49 has two rack portions 51 and 52 spaced 90° from each other, and depending on the selection of gears 15 or 16 for driving the carriage 3, see FIG. 1d, rack portion 51 or 52 is operative to support margin stops 49*a* projecting through and guided by a slot in wall 49*b* and having a pin 49*c* engaging neck portion 51. Margin stop 49*a* remains in its position when the margin stop rod 49 is shifted. As shown in FIG. 1*e*, and 1*d* carriage 3 has a projecting part 3*e* cooperating with the margin stops 49*a*, and rollers 3*b* rolling on rails 3*c*. The type head 3*a* is carried by carriage 3 and cooperates with a schematically illustrated platen 3*d*. As noted above, the type head 3*a* is exchangeable for using different types requiring carriage steps of different length.

Link 45 has a cam 55 with opposite slanted faces. A shiftable latch 56 has a slot 56*a* in which a stationary guide pin 57 is located, and a spring 58 biasses latch 56 toward cam 55. The end of latch 56 which cooperates with cam 55 has two oppositely slanted faces. When link 45 is shifted between the two end positions thereof, latch 56 is also shifted due to the action of cam 55. An arresting member 59 mounted on a stationary pivot 60, is pivotally connected with a lever 61 and with the other end of latch 56 by a pivot 87. Arresting member 59 performs the same operation as arresting lever 11 of the tabulator means 7, and operates tabulator means 7 when turned from the position shown in chain lines in FIG. 1*e* to the position shown in solid lines. Latch 56 is also pivotally connected by pivot 87 with a lever 61 guided on a pin 61*a*, and connected by a pivot 61*b* with a clearing member 62 which is guided by a pin 62*a*. Clearing member 62 can also cooperate with the tabs 2 of tab carrier 1, but clearing means 62 and 4 are located on opposite sides in circumferential direction of tabulator stop 6.

As noted above, the annular tab carrier 1 has as many tabs 2, 5 as carriage 3 performs single steps of the minimum basic step length within an entire movement of carriage 3 between its end positions. This is also true for the number of teeth 14 of escapement member 13 which is also annular and fixed to the tab carrier 1. Escapement member 13 and tab carrier 1 perform one complete revolution during a movement of the carriage 3 between its two end positions, relative to the escapement pawl 8 and the tabulator stop 6 of the tabulator means 7. The carriage movement, controlled by the tabulator means 7, or by the escapement mechanism 13, 8, is effected by the carriage drive spring 23 which is part of the drive means of the carriage 3, and the force of drive spring 23 is transmitted through the transporting roller 22 and the rope 24 to the carriage 3. When the smaller gear 15 is coupled by coupling key 18 to the tab carrier 1 and escapement member 13, the motion is transmitted at the ratio of 1 : 1. When transmission 17 is shifted, and the larger gear 16 is coupled by coupling key 18 with the tab carrier 1 and escapement member 13, the transmission ratio is greater than 1. It follows, that the tab carrier 1 performs equal steps from column to column independent of the effective ratio of the variable transmission 17, but makes in the condition of the transmission 17 in which the larger transmission gear 16 is effective, a movement relative to the movement of carriage 3, increasing the distance between the tabulator columns which means that the tabulator stop 6 is engaged by a tab 2 only when carriage 3 arrives there. When carriage 3 is driven by the transmission 17 with the larger gear 16 effective, carriage 3 performs fewer steps within its total movement between the end positions. As a consequence, correspondingly fewer tabs 2 of the tab carrier 1 cooperate with the tabulator stop 6 of the tabulator means 7. As a result, either the full number, or a lesser number of tabs 2 is used, in accordance with the length of the selected carriage steps.

As explained above, the operation of the tabulator means 7 for tabulating the carriage 3 to columns determined by set tabs 2 in the tab carrier 1, takes place due to depression of a tabulator key 65 which brings about an angular movement of the arresting lever 11 through pivot 65*d*, lever 65*b* mounted on stationary pin 65*c* and biased by spring 65*e*, and link 65*a* articulated to arm 11*b* of arresting lever 11. Spring 65*e*, together with spring 11*c* acting on arm 11*b* of arresting lever 11 hold tabulator key 65 and arresting lever 11 in the position of rest shown in FIG. 1*e*. The depressed tabulator key 65 effects turning of arresting lever 11 which releases arm 66 so that stop member 71 is turned by spring 10 and turns tabulator stop 7*a* 6 of tabulator means 7 into the path of movement of the tabs 2, 5, and arrests the tabulator means 7 in this position until the first set tab 2 releases the tabulator means 7 so that escapement pawl 8 is released by arm 7*b* of the tabulator means 7 and stops the carriage 3. The escapement pawl 8 which was previously turned out of the teeth of the escapement member 13 for releasing carriage 1, is again released by the arm 7*b* of tabulator member 71 of tabulator means 7 for engaging a tooth 14 of escapement member 13, since tabulator means 7 was shifted to the left, as viewed in FIG. 1*a* by a set tab 2 and thereby released from arresting member 59 for returning to the position of rest shown in chain lines in FIG. 1*e*. If no tab 2 is set, the fixed end tab 5 cooperates with the tabulator stop 6 in the tabulator means 7 to stop the carriage 3 in the end position, which requires that the path of the engagement face 5*a* of the fixed end tab 5 is always in the region of the tabulator stop 6 when carriage 3 is in the tabulated end position, irrespective of the length of the steps between the tabulator columns which carriage 3 makes. In this manner, in the returned end position of the carriage 3, at the beginning of a line when spring 23 is tensioned, the fixed end tab 5 is spaced many tab spaces from the tabulator stop 6, as there are single steps contained and tabs 2 are effective in the selected basic step division within the distance of carriage movement between the end positions of carriage 3. This is due to the fact that the shifting of the variable transmission 17 must be carried out in the tabulated end position of carriage 3, which means that the tab carrier 1 is moved already during the return movement of carriage 3 to the beginning of a line with correspondingly changed column distances. The presetting of the shifting operation of the transmission 17 can be effected in any position of carriage 3.

FIG. 1*e* illustrates the tabulating apparatus in a condition in which tabulator means 7 has been operated, and the force accumulator 42 is tensioned and prepared for the shifting of the coupling key 18 of the variable transmission 17, while carriage 3 is released by lifting escapement pawl 8 out of the teeth 14 of escapement member 13, the coupling key 18 being assumed to be coupled with the larger transmission gear 16. The transmission 17 and the coupling key 18 have been placed in this position by operation of the setting handle 50, margin stop bar 49 and lever 48 angularly in clockwise direction so that link 44, 55 has been shifted to the left to the position illustrated in solid lines out of the position shown in chain lines in FIG. 1*e*.

During this movement of link 45 of the linkage 48, 45, 42, latch 56 has been shifted by cam 55 on link 45 to its lower position, effecting turning of the arresting member 59 in counterclockwise direction. Arresting member 59 holds the tabulator means 7 with the tabulator stop 6 in the path of movement of the tabs 2, 5 on tab carrier 1, and arrests the tabulator means 7, and itself, in this position by engaging a corresponding cutout 66*a* in the portion 66 of the tabulator means 7. When the variable transmission 17 is shifted to the second stage, arresting member 59 carries out the function performed by arresting lever 11 during a normal tabulation of carriage 3. The latch 56 has simultaneously turned the link 61 in clockwise direction and shifted clearing member 62 into the path of movement of the tabs 2, 5. Link 45 has at the same time tilted the overcenter spring 44 of the force accumulator 42 relative to pin 43 of angular lever 41 so that angular lever 41 is turned in clockwise direction. Angular lever 41, by whose arm the coupling key 18 is shifted, biasses the coupling key 18 upward in the axial direction of shaft 12 toward the smaller transmission gear 15 while the coupling projections 31 abut the respective lateral face of gear 15. Carriage 3 is released in this condition of the apparatus, and performs a tabulating movement during which all set tabs 2, which could finish the tabulating movement of carriage 3 before its tabulated end position, are cleared by the clearing member 62 before arriving at the tabulator stop 6, so that the fixed end tab 5 is engaged by tabulator stop 6. This effects, as explained above, movement of the tabulator means 7 away from arresting member 59, and return of the tabulator means 7 to its initial position. Escapement pawl 8 is urged by spring 8a to engage a recess between the teeth 14 of the escapement member 13, and terminates the tabulating movement of carriage 3 to its tabulated end position. The clearing member 62, the arresting member 59, and the latch 56 return due to the action of spring 58 simultaneously to the respective positions of rest since the arresting engagement between arresting member 59 and the arm 66 of the U-shaped tabulator member 71 of tabulator means 7 was released in the meantime.

When carriage 3 arrives in the tabulated end position, the coupling recesses 29 and 30 of the transmission gears 15 and 16 register with each other so that coupling key 18 with its coupling projections 31 no longer engages the lateral surface of gear 15, and is drawn by the force accumulator 42 into the coupling recess 29 of gear 15. The shifting of transmission 17 to the position in which the smaller gear 15 is operative for effecting smaller standard carriage steps, has thus been carried out.

The shifting from smaller carriage steps to the larger carriage steps is carried out in the same manner, but the manually operated handle 50 is turned in counterclockwise direction, the link 45 is shifted to its right end position, as partly shown in chain lines, and the force accumulator 42 is shifted to act on coupling key 18 in the opposite direction than before, while tabulator means 7 is operated under the control of cam 55 through the linkage 56, 59. operated In the event that carriage 3 is already in the tabulated end position when the transmission 17 is shifted to a different length of the carriage steps, the coupling key 18 is immediately shifted, and tabulator means 7 is released by the slanted engagement face 5*a* at the lower end of the fixed end tab 5 already during movement of tabulator stop 6 into the path of movement of end tab 5 since it is shifted to the left by the slanted engagement face 5*a*.

Figure 2:
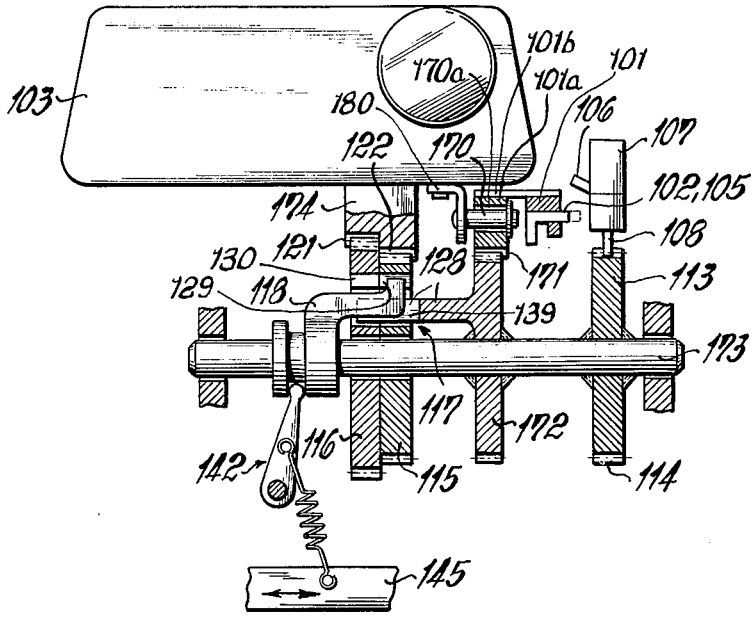
FIG. 2 is a fragmentary sectional view illustrating a second embodiment of the invention in which the tab carrier is mounted on the typewriter carriage.

In the embodiment of FIG. 2, a tab carrier 101 is mounted on the carriage 103 for relative movement in the longitudinal direction. The tab carrier 101 is constructed as a rack bar and has tabs 102 and a fixed end tab 105. As in the embodiment of FIG. 1, the total number of tabs 102, 105 corresponds to the number of the shortest carriage steps possible during a movement of carriage 103 between its end positions. The tab carrier 101 is connected by connecting pieces 101*b* with a rack bar 101*a*, 171. The tab carrier 101 has slots 170*a* through which pass guide means, shown to be pins 170 secured by brackets 180 to the carriage 103, so that the tab carrier 101 can move relative to carriage 103. The rack bar 101*a*, which is fixed to tab carrier 101, has a rack portion 171 which meshes with a gear 172 secured to a shaft 173 to which an escapement member 113 in the form of a gear is also fixedly secured. In this embodiment, the tab carrier 101 is connected with the escapement member 113 by rack bar 101a and gear 172, and the number of teeth 114 of the escapement member 113 can be different from the number of tabs 102, 105 on the tab carrier 101.

The escapement member 113 cooperates in the usual manner with an escapement pawl 108 which is lifted by tabulator means 107 out of the teeth 114 of escapement member 113 and is then released for engagement of the escapement member 113 and stopping of carriage 103 by the cooperation of the tabulator stop 106 of a tabulator means 107 with the tabs 102, and with end tab 105, now shown.

The intermediate gear 172 has an axially projecting guide fork 128 which has prongs 139 between which a coupling key 118 is mounted for sliding movement in axial direction, as described with reference to FIS. 1*a* to 1*e*. Coupling key 118 is freely rotatable on shaft 173, and shifts the distance changing transmission 117 by means of recesses 129 and 130 of gears 115 and 116 between two stages when operated by a manually operated link 145 corresponding to link 45 in the embodiment of FIG. 1e. A force accumulating means 142 is provided between the manually operated link 145 and the coupling key 118, and transmits the shifting motion to coupling key 118. The transmission gears 115 and 116 are freely rotatable on shaft 173 and are respectively meshing with two racks 122 and 121 forming part of a bar 174 fixedly secured to the carriage 103. By shifting the coupling key 118 in the aligned coupling slots 129, 130, the ratio of the transmission 117 is changed depending on whether gear 115 or gear 116 is effective to transmit motion through guide fork 128 to intermediate gear 172 and the rack 171 of tab carrier 101. The diameter of transmission gear 115 corresponds to the diameter of the intermediate gear 172, while the transmission gear 116 has a greater diameter. The transmission 117 and guide fork 128 are substantially constructed and operated as described with reference to the transmission 17 shown in FIG. 1c.

The steps determined by escapement pawl 108 and escapement member 113 are transmitted to carriage 103 through guide fork 128 of intermediate gear 172, coupling key 118, and transmission gear 115 to carriage 103, when the same is to move with the smallest basic steps. At the same time, this stepwise movement is transmitted in the ratio of 1 : 1 from carriage 103 through intermediate gear 172 to the tab carrier 101. It follows that the tabulating movements of carriage 103 and of the tab carrier 101 are in the ratio of 1 : 1, so that all tabs 102, 105 can cooperate with the tabulator stop 106 of the tabulator device 107 in each column.

If the distance changing transmission 117 is shifted, the carriage 103 performs greater steps than before due to the fact that the greater transmission gear 116 is now effective. Consequently, carriage 103 can perform fewer steps within its total movement between its end positions. The tab carrier 101 is moved with small basic steps from column position to column position, as before, so that correspondingly fewer tabs 102 of tab carrier 101 cooperate with the tabulator stop 106 of the tabulating device 107.

As in the embodiment of FIGS. 1*a* to 1*e*, the embodiment of FIG. 2 also provides a relative movement between the tab carrier 101 and the carriage 103, if carriage 103 is to move in steps larger than the basic small steps. When the carriage 103 moves in small steps, the full capacity of the tab carrier 101 is used, but this is not the case when the carriage 103 moves with the larger steps. Otherwise, the construction and embodiment of the tabulating apparatus shown in FIG. 2 corresponds to the construction and embodiment of the tabulator apparatus shown in FIGS. 1*a* to 1*e*.

Figure 3:
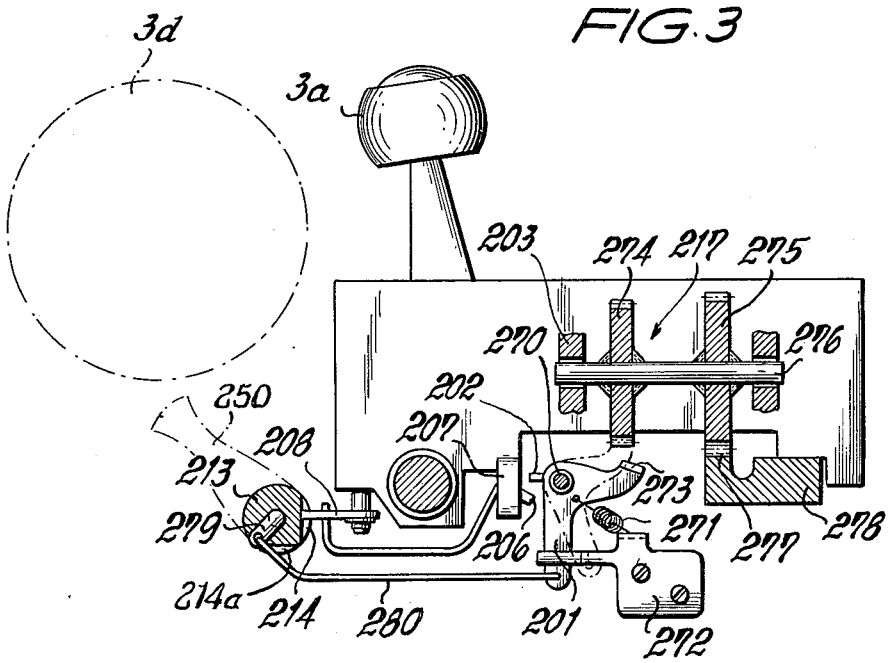
FIG. 3 is a fragmentary sectional view illustrating a third embodiment of the invention in which the tab carrier is mounted in the frame of the typewriter.

FIG. 3 illustrates the third embodiment of the invention in a condition in which the carriage 203 is moved with the smallest basic steps. The tab carrier 201 is mounted on a stationary shaft 270 whose axis is parallel to the direction of the movement of carriage 203, so that tab carrier 201 can move along and about shaft 270. During a tabulating movement of carriage 203, the tab carrier 201 on shaft 270 is in a position of rest and remains in this position of rest abutting an abutment 272 due to the action of a spring 271 connecting the tab carrier 201 with the abutment 272. Carriage 203 moves with the tabulator means 207 and the tabulator stop 206 along the tab carrier 201, until tabulator stop 206 engages one of the tabs 202, and stops the tabulating movement. The transmission gear 275 of the shiftable transmission 217, continuously meshes with the rack teeth 277 of a stationary rail 278, while transmission gear 274 is ineffective.

The rod or escapement member 213 has two rack portions 214, 214*a* of different pitch, and can be manually turned by handles 250 secured to escapement member 213, which performs the function of the escapement member 13 described with reference to FIGS. 1*a* to 1*e*, cooperating with an escapement pawl 208 mounted on the carriage 203.

When escapement member 213 is turned in counterclockwise direction, as viewed in FIG. 3, for obtaining a greater step of carriage 203, this movement is transmitted by a fixed arm 279 and a link 280 to the tab carrier 201 so that the same is angularly displaced to a position in which the rack 273 meshes with gear 274 of transmission 217. During the following tabulating operation, or during movement of the carriage 203 in steps, the tab carrier 201 is operated by gear 274 to perform a movement relative to the movement of the carriage 203 due to the action of the spring 271, and also taking place in the direction of the carriage movement.

The ratio between transmission gears 274 and 275, which are fixedly secured to a transverse shaft 276 mounted for rotation on carriage 203, is selected so that the smaller transmission gear 274 transmits between column steps of carriage 203, such a longitudinal movement to the tab carrier 201 that the distance of relative movement corresponds to the increase from the smaller to the greater step length. In this manner, the embodiment of FIG. 3 also obtains the result that the carriage 203 can be tabulated into selected tabulated positions in accordance with the different length of the steps. Otherwise, the embodiment of FIG. 3 is operated as described with respect to the embodiments of FIGS. 1*a* to 1*e* and FIG. 2, the only difference being that in the tabulated condition of carriage 203, the rack 273 of the tab carrier 201 and the teeth of gear 274 of transmission 217 register. The escapement member 213 can be manually shifted by handle 250 between two angular positions in which rack portion 214 or 214*a* is effective.

In the above-described embodiments, only two transmission gears 15,16; 115,116; 274,275; are provided for each of the variable transmissions 17, 117, and 217 corresponding to two different lengths of carriage steps and to two different type heads *3a*. Evidently, the arrangement can be modified to permit the use of three or more type heads *3a* with different types, and movement of the carriage 3, 103, 203 with three or more different steps.

It will be understood that each of the elements described above, or two or more together, may also find a useful application in other types of tabulator apparatus for a typewriter carriage differing from the types described above.

While the invention has been illustrated and described as embodied in a tabulator apparatus for a typewriter carriage 3 moving in steps of different length corresponding to different types on different exchangeable type heads 3a, it is not intended to be limited to the details shown, since various modifications and structural changes may be made without departing in any way from the spirit of the present invention.

Without further analysis, the foregoing will so fully reveal the gist of the present invention that others can be applying current knowledge readily adapt it for various applications without omitting features that from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

We claim:

1. Tabulator apparatus for a typewriter carriage moving in steps of different length, comprising carriage means movable between two end positions; two racks secured to said carriage means; drive means for moving said carriage means; escapement means including a toothed escapement member and an escapement pawl cooperating with said escapement member; tabulator means including a tab carrier mounted for longitudinal movement relative to said carriage means, and having a rack portion, said tab carrier being connected with said escapement member for movement therewith, a series of tabs mounted on said tab carrier spaced from each other a predetemined distance corresponding to the length of the steps of said escapement member, and a tabulator stop means cooperating with said tabs; and transmission means connecting said escapement member and said tab carrier with said carriage means, and including a shaft on which said escapement member is fixedly mounted, at least two different transmission gears rotatably mounted on said shaft, and meshing with said racks, respectively, and a coupling key movable on said shaft and operable to connect one of said different transmission gears with said shaft, another gear fixed to said shaft and meshing with said rack portion, and having a guide portion coupled with said coupling key, said transmission means having a first stage in which said carriage means is controlled by said escapement means to move between said end positions in steps having the length of said predetermined distance, and a second stage in which said carriage means moves in steps having a length greater than said, predetermined distance so that said carriage means and said tab carrier more relative to each other to increase the distance between tabulating columns whereby not all tabs of said series of tabs cooperate with said tabulator stop means; and manually operated means for shifting said coupling key and thereby said transmission means between said first and second stages.

2. Tabulator apparatus for a typewriter carriage moving in steps of different length, comprising carriage means movable between two end positions; drive means for moving said carriage means; escapement means including a toothed escapement member and an escapement pawl cooperating with said escapement member; tabulator means including a tab carrier connected with said escapement member for movement therewith, a series of tabs mounted on said tab carrier spaced from each other a predetermined distance corresponding to the length of the steps of said escapement member, and a tabulator stop means cooperating with said tabs; and transmission means connecting said escapement member and said tab carrier with said carriage means, said tab carrier, and said transmission means being circular, having central aligned bores and forming a unit with said escapement member, said transmission means including a shaft located in said central aligned bores rotatably supporting said unit, at least two different transmission gears rotatably mounted on said shaft and connected with said carriage means, and a coupling key movable on said shaft between first and second positions engaging said two transmission gears, respectively, in first and second stages of said transmission means for coupling a selected one of said transmission gears with said escapement member and said tab carrier; said tab carrier having a guide fork axially projecting from said tab carrier, said two transmission gears having sector-shaped cutouts, and coupling recesses in said cutouts, said guide fork having two prongs projecting into said cutouts, and said coupling key being located and guided between said prongs and having at least one coupling projection located in one of said coupling recesses of said transmission gears for coupling the respective transmission gear and thereby said carriage means with said tab carrier and said escapement member, said carriage means being controlled in said first stage of said transmission means by said escapement means to move between said end positions in steps having the length of said predetermined distance, and being controlled in said second stage to move in steps having a length greater than said predetermined distance so that said carriage means and said tab carrier move relative to each other to increase the distance between tabulating columns whereby not all tabs of said series of tabs cooperate with said tabulator stop means; and manually operated means for shifting said coupling key so that said trasmission means is shifted between said first and second stages.

3. Tabulator apparatus as claimed in claim 2 wherein said two transmission gears have peripheral gear rings; wherein said sector-shaped cutouts are located inward of said peripheral gear rings, respectively; and wherein said coupling recesses include coupling recesses projecting radially from said cutouts directly inward of said peripheral gear rings, respectively.

4. Tabulator apparatus as claimed in claim 2 wherein said transmission means includes adjusting means for varying the ratio of said transmission means; and wherein said manually operated means are connected with said adjusting means for operating said adjusting means.

5. Tabulator apparatus for a typewriter carriage moving in steps of different length, comprising carriage means movable between two end positions; drive means for moving said carriage means; escapement means including a toothed escapement member and an escapement pawl cooperating with said escapement member; tabulator means including a tab carrier secured to said escapement member for movement therewith, a series of tabs mounted on said tab carrier spaced from each other a predetermined distance corresponding to the length of the steps of said escapement member, and a tabulator stop means cooperating with said tabs; and transmission means connecting said escapement member and said tab carrier with said carriage means, said tab carrier, and said transmission means being circular, having central aligned bores and forming a unit with said escapement member, said transmission means including a shaft located in said central aligned bores rotatably supporting said unit, at least two different transmission gears rotatably mounted on said shaft and connected with said carriage means, and a coupling key movable on said shaft between first and second positions engaging said two transmission gears, respectively, in first and second stages of said transmission means for coupling a selected one of said transmission gears with said escapement member and said tab carrier, said carriage means being controlled in said first stage of said transmission means by said escapement means to move between said end positions in steps having the length of said predetermined distance, and being controlled in said second stage to move in steps having a length greater than said predetermined distance so that said carriage means and said tab carrier move relative to each other to increase the distance between tabulating columns whereby not all tabs of said series of tabs cooperate with said tabulator stop means; and manually operated means for shifting said transmission means between said first and second stages, including a manually operated member, a first linkage connecting said manually operated member with said tabulator stop means for operating said tabulator stop means, and a second linkage connected with said coupling key and having two linkage end positions for moving said coupling key between said first and second positions, and including a force accumulator having an arm connected with said coupling key.

6. Tabulator apparatus as claimed in claim 5 wherein said force accumulator includes an angular lever having said arm, a pivot supporting said angular lever for movement between two end positions, a spring connecting said second linkage with said angular lever and passing in a dead center position over said pivot during movement of said angular lever between said linkage end positions for holding said angular lever in said lever end positions and said coupling key in said first and second positions.

7. Tabulator apparatus as claimed in claim 6 wherein said second linkage includes a shiftable link operated by said manually operated member to move between two positions, said shiftable link having a cam projection; and wherein said first linkage includes a spring biassed shiftable latch operated by said cam projection during movement of said shiftable link between said two positions, and means connecting said shiftable latch with said tabulator stop means for moving said tabulator stop means between an inoperative position and a position projecting into the path of said tabs.

8. Tabulator apparatus as claimed in claim 7 including clearing means for said tabs; and wherein said first linkage includes means operated by said spring biassed shiftable latch to actuate said clearing means.

9. Tabulator apparatus as claimed in claim 7 wherein said shiftable link has a guide slot having arresting recesses at the ends thereof; comprising a stationary arresting pin means in said guide slot; wherein said spring has one end connected with said angular lever, and the other end connected with said shiftable link for urging said arresting recesses against said arresting pin means in said two positions of said shiftable link.

10. Tabulator apparatus as claimed in claim 9 wherein said second linkage includes a turnable margin stop rod secured to said manually operated member, and havng a fixed lever arm connected with said shiftable link so that angular displacement of said manually operated member shifts said shiftable link between said two positions; and wherein said margin stop rod has two rack portions respectively operative in said two positions, said two rack portions having differently spaced teeth, respectively; and margin stop means on one of said rack portions.

11. Tabulator apparatus for a typewriter carriage moving in steps of different length, comprising carriage means including a transverse shaft mounted for free rotation, said carriage means being movable between two end positions; drive means for moving said carriage means; escapement means including a toothed escapement member and an escapement pawl cooperating with said escapement member; a transmission including two different transmission gears; a stationary rack bar meshing with one of said transmission gears; a stationary longitudinal shaft; tabulator means including a tab carrier mounted on said longitudinal shaft for turning in axial movement and having a rack portion meshing in one angular position with the other transmission gear of said transmission gears, a series of tabs mounted on said tab carrier spaced from each other a predetermined distance corresponding to the length of the steps of said escapement member, and a tabulator stop means cooperating with said tabs; said transmission means connecting said escapement member and said tab carrier with said carriage means and having a first stage in which said carriage means is controlled by said escapement means to move between said end positions in steps having the length of said predetermined distance, and a second stage in which said carriage means moves in steps having a length greater than said predetermined distance so that said carriage means and said tab carrier move relative to each other to increase the distance between tabulating columns whereby not all tabs of said series of tabs cooperate with said tabulator stop means; and manually operated means for shifting said transmission means between said first and second stages.

12. Tabulator apparatus as claimed in claim 11 wherein said one transmission gear is larger than said other transmission gear.

13. Tabulator apparatus as claimed in claim 12 including a stationary stop for said tab carrier; and a spring connecting said tab carrier with said stationary stop.

14. Tabulator apparatus as claimed in claim 13 wherein said escapement member is a turnable bar having two angularly spaced rack portions of different tooth pitch; wherein said manually operated means are connected with said escapement member for turning said escapement member between two positions in which said angularly spaced rack portions cooperate with said escapement pawl, respectively; a lever fixed to said escapement member; and a link connecting said lever with said tab carrier so that said tab carrier is turned to and from said angular position by turning of said escapement member.

* * * * *